US005333555A

United States Patent [19]

McPhee

[11] Patent Number: 5,333,555

[45] Date of Patent: Aug. 2, 1994

[54] PALLET CONSTRUCTED WITHOUT NAILS

[76] Inventor: Bruce A. McPhee, Chandlers Lane, Wyong Creek, Wyong, NSW 2259, Australia

[21] Appl. No.: 920,504

[22] PCT Filed: Feb. 19, 1991

[86] PCT No.: PCT/AU91/00058

§ 371 Date: Oct. 16, 1992

§ 102(e) Date: Oct. 16, 1992

[87] PCT Pub. No.: WO91/13009

PCT Pub. Date: Sep. 5, 1991

[30] Foreign Application Priority Data

Feb. 20, 1990 [AU] Australia ..... PJ8728/90

[51] Int. Cl.[5] ..... B65D 19/00

[52] U.S. Cl. ..... 108/51.1; 108/56.1

[58] Field of Search ..... 108/51.1, 56.1, 56.3, 108/51.3

[56] References Cited

U.S. PATENT DOCUMENTS

| | | | |
|---|---|---|---|
| 2,634,931 | 4/1953 | Weitzel | 108/51.1 |
| 2,817,485 | 12/1957 | White et al. . | |
| 2,933,339 | 4/1960 | Bror et al. . | |
| 3,878,796 | 4/1975 | Morrison | 108/56.1 |
| 4,062,301 | 12/1977 | Pitchford | 108/56.1 |
| 4,220,099 | 9/1980 | Marchesano | 108/51.1 |

FOREIGN PATENT DOCUMENTS

| | | |
|---|---|---|
| 3257384 | 9/1985 | Australia . |
| 3045167 | 7/1982 | Fed. Rep. of Germany . |
| 8906625 | 7/1989 | PCT Int'l Appl. . |

*Primary Examiner*—Jose V. Chen

*Attorney, Agent, or Firm*—Zarley, McKee, Thomte, Voorhees, & Sease

[57] ABSTRACT

A pallet having no nails in its construction comprises a pair of metal (preferably steel) bearers of rectangular cross-section, between which two linear arrays of planks or slats extend. Each bearer has an inner wall, an outer wall, an upper wall and a lower wall. The ends of the planks or slats are positioned in respective openings of linear arrays of openings formed in (i) the corner formed by the inner wall and the upper wall and (ii) the corner formed by the inner wall and the lower wall, of each bearer. Slots in one face of each plank or slat near each end thereof locate each plank by receiving the inner wall edges of respective openings of the bearers. The natural resilience of the timber of each plank or slat, combined with choice of the dimensions of the openings in the bearers, ensures that the pallet will be rigid. The planks or slats may be of softwood.

9 Claims, 3 Drawing Sheets

PALLET CONSTRUCTED WITHOUT NAILS

TECHNICAL FIELD

This invention concerns pallets. More particularly, it concerns a pallet made from steel and wood without the use of nails. Such a pallet can be manufactured using relatively inexpensive wood, nevertheless it will be strong and capable of withstanding the usual treatment to which pallets are subjected.

BACKGROUND

The conventional pallet is made entirely of hardwood. The conventional pallet comprises bearers, aligned parallel to each other and connected to each other by two linear arrays of cross-planks or slats. Each slat of one of the linear arrays is nailed, at each end, to the upper surface of a respective one of the bearers. Each slat of the other linear array is nailed, at each end, to the bottom face of a respective bearer. Usually, each slat is also nailed to a central bearer which is located between the main bearers. Hardwood has to be used for the cross-planks (slats) and bearers of such pallets, even though it is considerably more expensive than softwood timber such as pine, because nails are used to assemble the pallet.

In addition to the cost factor in the manufacture of a wooden pallet (which is partly related to the increasing difficulty in obtaining suitable hardwood), the conventional wooden pallet has a number of disadvantages. The disadvantages include:

(a) the fact that the pallets are easily damaged by careless handling by the operators of fork-lifts, particularly (i) when the tynes of the fork-lift strike an end slat and dislodge it from its associated nails, and hence from the bearers, and (ii) when a fork-lift tyne is pushed into the end grain of a bearer during movement of the pallet by the fork-lift prior to the lifting of the pallet by the fork-lift, thus splitting the timber of the bearer;

(b) the fact that when (as often happens) a pallet is dropped from a truck or loading dock and lands on a corner, the pallet is distorted diagonally;

(c) the possibility of damage being caused to goods on the pallet which have been bagged or packed in cartons, by any nails protruding from the pallet;

(d) the inherent weakening of the timber slats when nails are driven through the ends of the slats - often causing the wood of the slat to split; and (e) a badly damaged pallet is a complete waste of a timber resource, for a badly damaged pallet cannot readily be used as low-cost firewood in view of the expense incurred in the labour-intensive task of removing the nails to make the timber suitable for firewood.

It has long been recognised that it would be advantageous if a nail-free pallet could be provided in place of the conventional wooden pallet.

A number of alternative pallet constructions have been tried, but none has been successful. For example, pallets have been made entirely of metal. One example of such a metal pallet is described in the specification of West German patent application No P 21 11 135.3. Unfortunately, when that type of pallet is lifted on the metal tynes of a fork-lift, the slats of the pallet tend to slide on the tynes as a result of the lack of friction, with potentially disastrous results.

Other types of nail-free pallet have been described in (i) the specification of my Australian patent application No. 32537/84, (ii) the specification of West German patent No 912317, and (iii) the specification of my International patent application No PCT/AU89/00017 (WIPO publication No 89/06625). Those pallets, however, are either not strong enough to withstand the structural stresses to which pallets are subjected in normal use, or they are too expensive to manufacture to be commercially viable.

DISCLOSURE OF THE PRESENT INVENTION

It is an object of the present invention to provide a nail-free pallet which avoids, or minimises, the above-noted disadvantages of the conventional wooden pallet, and which is nevertheless able to be produced at a cost which makes the pallet commercially attractive.

This objective is achieved by a pallet which has two bearers fabricated from metal (preferably steel), between which two linear arrays of wooden slats or planks extend. Each bearer has a hollow rectangular cross-section. A series of rectangular openings are cut into the corners of the bearers at the top and bottom of their opposed faces (that is, into the upper and lower inner corners of the bearers). The openings have dimensions such that the ends of the slats are width-wise a close fit within them. A pair of slots are formed in one face of each plank, each slot being a distance from a respective end of the plank or slat which is equal to or less than the distance between the face within a bearer of the inner wall of the bearer and the face within the bearer of the outer wall of the bearer. The width of each slot is substantially equal to the thickness of the inwardly facing opposed walls of the bearers. The vertical extent of each of the openings at an inner corner of a bearer is such that when the ends of the planks are inserted into the openings and the pallet is assembled, the portions of the inner walls of the bearers which are vertically adjacent to the openings are positioned within the slots in the planks or slats, and the resilience of the planks or slats is such that each end of each plank or slat is pressed upwardly or downwardly, as the case may be, against the upper or lower (horizontal) wall of a bearer. In this way a rigid pallet structure is produced.

To assemble such a pallet, a jig is required, with means (such as a cam or a member of elliptical or generally oval cross-section) to bend the slats or planks to enable their ends to be inserted in the openings in the bearers.

Thus, according to the present invention, there is provided a pallet comprising a pair of elongate bearers separated by an upper array of planks or slats and a lower array of planks or slats, each plank or slat having its longitudinal direction at right angles to the elongate direction of the bearers, characterised in that:

(a) each bearer is a hollow metal member of rectangular cross section, having an upper wall, a lower wall, an inner wall and an outer wall;

(b) each bearer has an upper and a lower linear array of openings formed in the corners of the bearer at (i) the junction of the upper wall and the inner wall and (ii) the junction of the lower wall and the inner wall, each of said openings having a width such that it receives one end of one of said slats or planks;

(c) each slat or plank has a pair of slots formed in one face thereof, each slot extending at right angles to the elongate direction of the slat or plank and having a thickness substantially equal to the thickness of the inner wall of a bearer, each slot being a distance from a respective end of its slat or plank which is equal to or less than the distance between the faces within a bearer of its inner and outer walls; and (d) the vertical distance between the level of the inside face of the upper wall and the level of the lowermost horizontal edge of an opening in the upper corner of a bearer is equal to the vertical distance between the level of the inside face of the lower wall and level of the uppermost horizontal edge of an opening in the lower corner of a bearer, which is slightly less than the distance between the bottom of a slot in a slat or plank and the face of such slat or plank in which a slot is not formed.

Preferably the metal bearers are steel bearers, but other suitable metals (and alloys) may be used.

In the case of bearers made from steel, each bearer may be fabricated from a length of channel section, to which an elongate steel plate has been welded across the ends of the arms of the channel section. With this construction, the steel plate will usually form the inner wall of the bearer. Each end of each bearer is preferably closed by a rectangular end plate.

If the bearers are formed by welding an elongate steel plate across the ends of the arms of a channel section steel member, corresponding linear arrays of rectangular openings will normally be pressed or cut out of the edges of the elongate steel plate and the outer edges of the arms of the channel section before the elongate steel plate is welded to the channel section.

To enable the pallet to be moved by a fork-lift approaching the side of the pallet (which is not possible with a conventional wooden pallet), each bearer may have a pair of correspondingly located rectangular apertures ("side apertures") in its inner and outer wall. Each such rectangular side aperture will have dimensions which enable it to loosely receive a tyne of a fork-lift and the centres of the side apertures in each wall of the bearer will be spaced apart by a distance equal to the separation of the centres of the tynes of a fork-lift. In such a construction, a short length of box section metal may extend between the corresponding side apertures in the inner and outer wall, and be welded to the inner and outer walls, to provide access channels for the tynes of the fork-lift.

The pallet may be supplied in kit form for assembly by a user.

An embodiment of the pallet of the present invention will now be described, by way of example only, with reference to the accompanying drawings.

DETAILED DESCRIPTION OF THE ILLUSTRATED EMBODIMENTS

Figure 1:
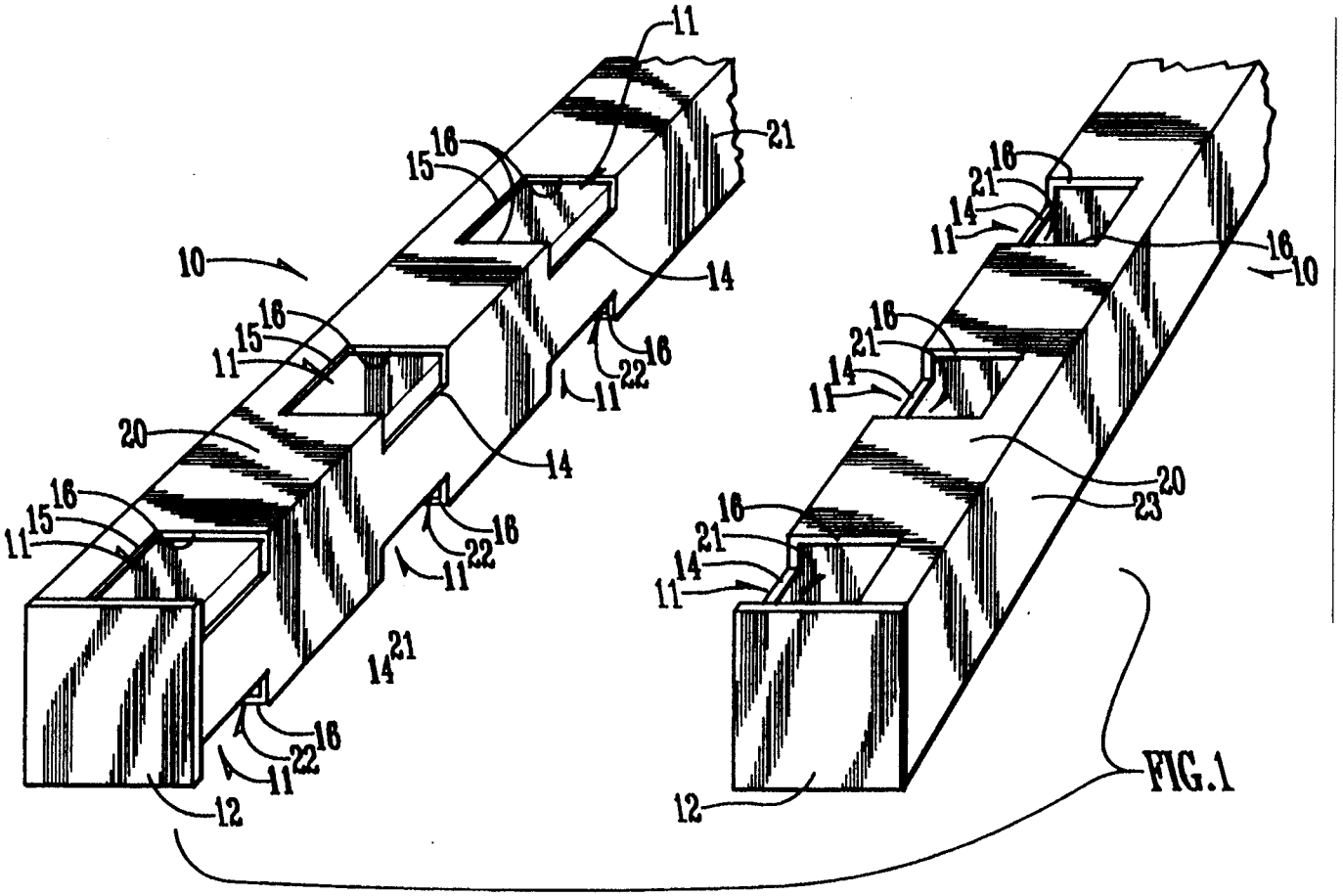
FIG. 1 is a perspective sketch of the ends of a pair of bearers, positioned ready to receive the slats or planks of a pallet constructed in accordance with the present invention.

The bearers 10 illustrated in FIG. 1 each consist of a hollow metal (usually, and preferably, steel) member of rectangular cross-section, closed at each end by a steel plate 12. Each bearer has an upper wall 20, a lower wall 22, an inner wall 21 and an outer wall 23. A series of openings 11 are formed in the upper and lower inner corners of the bearers by removing rectangular portions of the upper wall 20, the lower wall 22 and the inner wall 21. Each opening 11 is bounded by an edge 14 in an inner wall 21, an edge 15 in an upper wall 20 or a lower wall 22 (as the case may be) and a pair of side edges 16, each of which contain a right angle.

Figure 2:
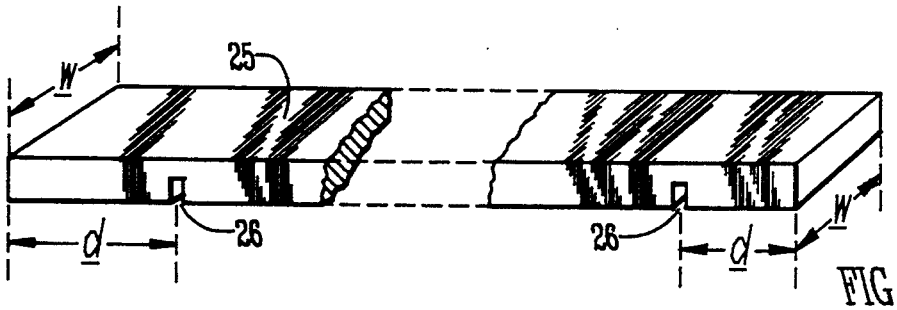
FIG. 2 is a perspective sketch of one of the top slats or planks of the pallet of the present invention.
Figure 3:
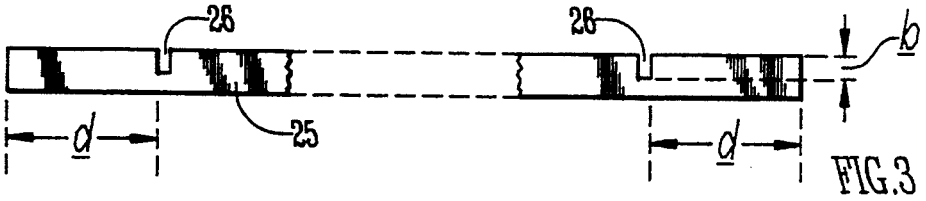
FIG. 3 is a side view of one of the bottom slats or planks of the pallet of the present invention.

The shape of the upper and lower slats or planks 25 which fit into the openings 11 is shown in FIGS. 2 and 3, respectively. Each plank has a width w. A pair of slots 26 are formed in one face of each plank. The slots 26 are a distance d from a respective end of the plank or slat. The width w is substantially equal to (but very slightly less than) the spacing between the edges 16 of one of the openings 11 in the bearers 10, so that a plank or slat end, if inserted into an opening 11, is a tight fit therein. The distance d must not be greater than (and is preferably approximately equal to) the distance, within the hollow centre of a bearer, between the inside faces of the inner wall 21 and the outer wall 23. This distance is shown as a in FIG. 5.

The width of each slot 26 is substantially equal to the thickness of an inner wall 21 of a bearer. The distance b between the bottom of each slot 26 and the face of the plank which does not have a slot 26 in it is slightly greater than the vertical separation between an edge 14 of an opening 11 and the inside face (that is, the face within the hollow bearer) of the adjacent wall 20 or 22 (as the case may be).

Figure 4:
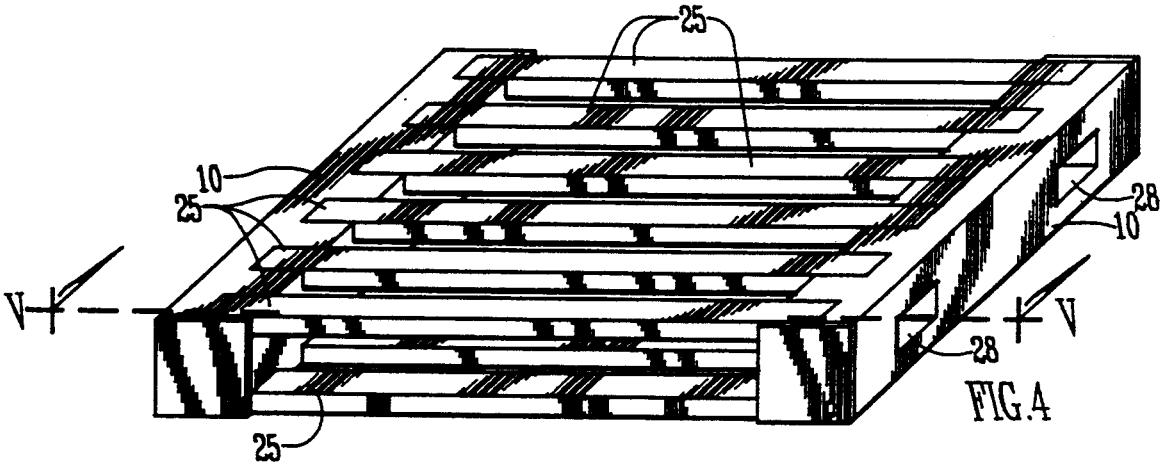
FIG. 4 is an oblique view of a pallet constructed in accordance with the present invention.
Figure 5:
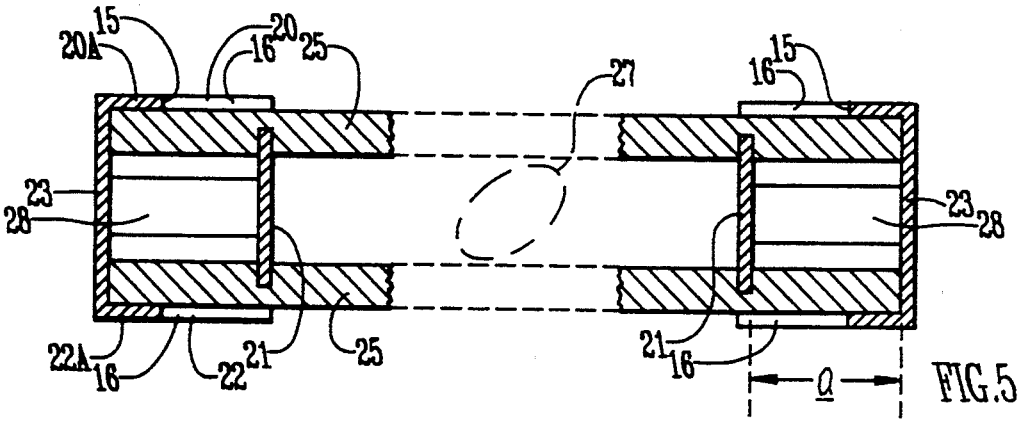
FIG. 5 is a sectional view at V—V of FIG. 4.

Thus, to fit the planks or slats 25 into the openings 11 to produce a pallet as shown in FIGS. 4 and 5 of the accompanying drawings, it is necessary to flex the planks slightly, preferably by holding them in a jig and applying a central force using a centrally-mounted cam or an elliptical or generally oval-shaped member 27, shown in dashed outline in FIG. 5. Removal of this central force by turning the member 27 and withdrawing it and the associated jig allows the natural resilience of the planks to cause them to straighten and adopt the position shown in FIGS. 4 and 5. In this position, the natural resilience of the planks causes the end regions of the planks to bear against the adjacent portions 20A and 22A, respectively, of the walls 20 and 22 of the bearers 10. The portions 20A and 22A are the regions of the walls 20 and 22 which are between the openings 11 and the outer wall 23 of each bearer. (Note that the extent of the portions 20A and 22A controls the minimum possible value of the distance d.)

When a pallet comprising a pair of linear arrays of planks or slats 25 positioned within the openings 11 as shown in FIGS. 4 and 5 has been assembled, the pallet is a rigid structure. Indeed, to dis-assemble the pallet, the Dig and central member 27 will normally be required again.

The timber from which the slats or planks 25 are made need not be hardwood, but can be pine or any other suitable commercially-grown timber. Thus constructing pallets in accordance with the present invention can be environmentally sound, since depletion of resources of hardwood can be avoided. Furthermore, if a pallet constructed in accordance with the present invention is badly damaged (despite the improved construction), the timber component of the discarded pallet can be used as low-cost firewood and the metal bearers can be re-smelted.

The pallet illustrated in FIG. 4 includes the optional feature of access at the side of the pallet for the tynes of a fork-lift. This side access is provided by a pair of box section lengths 28 of metal (steel) positioned within each bearer and held in position by welding the box sections to the inner wall 21 and the outer wall 23 of the bearer.

One method of constructing the bearers 10 is by welding a steel plate to the edges of a steel channel-shaped member, after appropriate rectangular regions have been removed from the edges of the steel plate and also from the outer edges of the arms of the channel-shaped member. The components used for this method of construction of the channel member and the steel plate are shown in FIG. 6.

Figure 6:
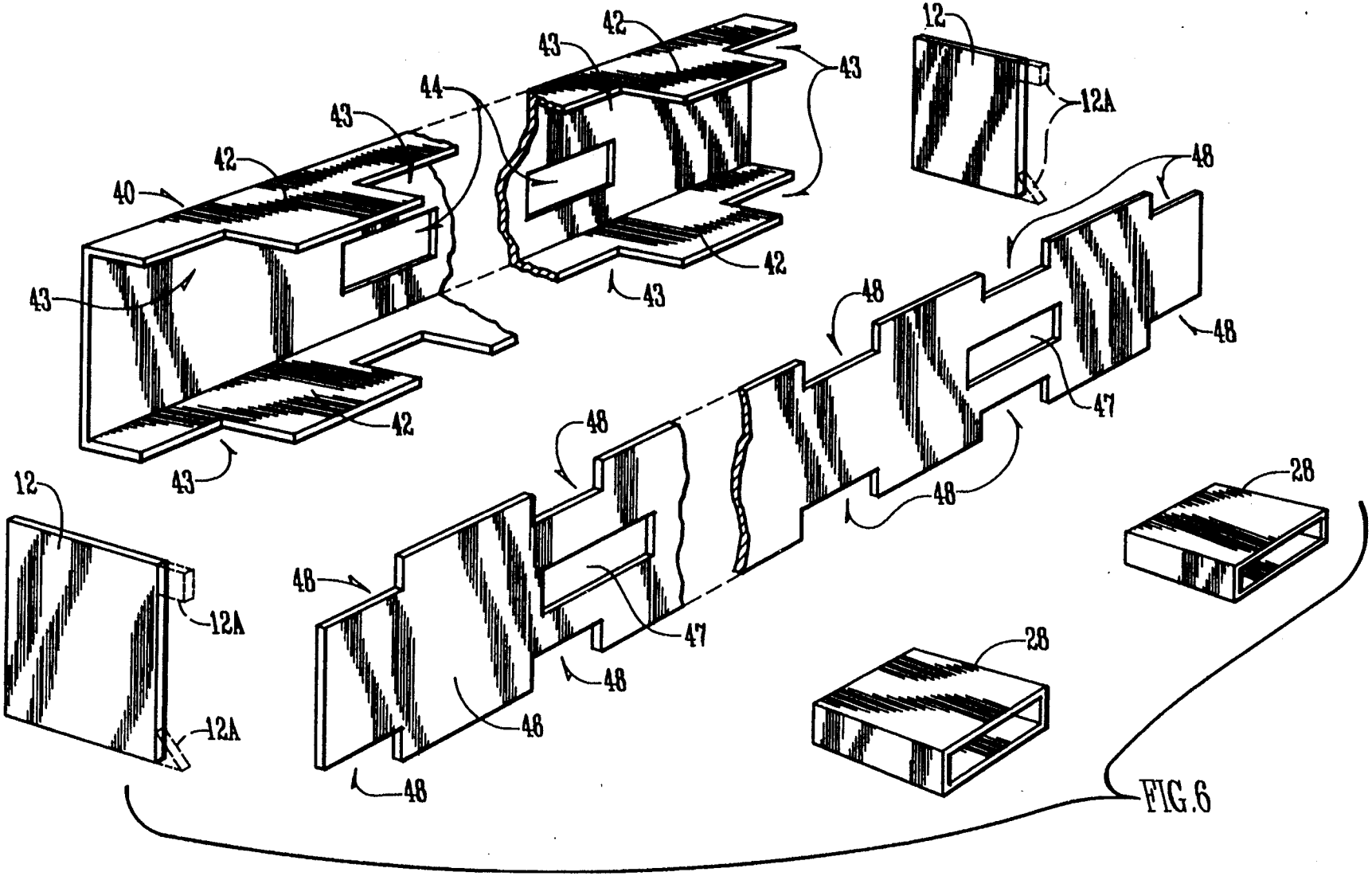
FIG. 6 illustrates the components for contructing the bearers of a pallet having some of the optional features described in this specification.

The bearer that is constructed from the components illustrated in FIG. 6 has the optional side access for the tynes of a fork-lift, defined by two lengths of steel box section 28. To support the box sections 28, a pair of rectangular apertures 44 are cut into the web 41 of the channel member 40 and a corresponding pair of apertures 47 are cut into the steel plate 46. (The steel plate 46 has the same length as the channel member 40.) An array of rectangular regions 43 are pressed or cut from the outer edges of each arm member 42 of the channel member 40. Each rectangular region 43 has the same dimensions. The rectangular regions in each arm member 42 are equi-spaced from each other; there is a rectangular region 43 at each outer corner of the arm members 42. Rectangular regions 48 are also cut out of the edges of the steel plate 46, in positions corresponding to the positions of the rectangular regions 43 removed from the arm members 42.

The plate 46 is welded across the arm members 42 of the channel member 40 to convert the channel member 40 into a hollow steel member of rectangular cross-section, with openings 11 created by the adjacent cut-out regions 43 and 48.

If the optional side access for fork-lift tynes is required, the box-section lengths 28 are then positioned between respective pairs of apertures 44 and 47 and welded in those positions.

A rectangular plate 12 is then welded to each end of the hollow steel member of rectangular cross-section to complete the construction of a bearer 10 of the present invention. Preferably, each steel plate 12 has a pair of tongues 12A of rectangular, triangular or other appropriate shape extending from its corners which are adjacent to the end openings 11 of the bearer, to provide extra protection for the end planks or slats of the pallet.

The channel section member 40 and the elongate plate 46 are preferably made from 3 mm thick high-tensile steel (HI10 or LI10) and the end plates 12 are preferably of 6 mm steel. However, lighter gauge steel, or heavier gauge steel, may be used. The assembled bearer is preferably square in section, measuring 150 mm by 150 mm. (Note: a square is a special instance of a rectangle.)

The presently most preferred construction of the bearers of the present invention involves the production of a flat steel member with apertures punched or cut from it at the appropriate locations. The flat steel member is then press-bent to form a bearer with an overlap region. The overlap region can be spot welded, or lengths of the overlap can be welded, to ensure the bearer retains its required rigidity when used in a pallet.

After the bearers 10 have been fabricated, the pallet is assembled in the manner described above. It will be appreciated that in order to achieve the optimum strength of the pallet, each plank or slat 11 should have the same length, and be square at its ends.

It will also be appreciated that the present invention has enabled a rigid and strong pallet to be constructed without the use of nails, and that when performing the present invention, the option of using softwood planks or slats in place of hardwood planks or slats, and the avoidance of some of the sources of damage to conventional pallets, adds to the economical viability of the present invention. The feature of having "recyclable" materials in the event of serious damage to a pallet makes the present invention ecologically sound as well as further enhancing its economic position. Another benefit of the present invention is that the name or trade mark of the owner of the pallet may be pressed into or welded onto the outer walls 13 of the bearers of the pallet, thus enabling the owner of the pallet to be readily identified. With conventional wooden pallets, the owner's name is usually painted on to the bearers of a pallet, and the paint is abraded off during use of the pallet. Thus the owner of a pallet that has been used for a reasonable period cannot be identified readily.

It should be noted that although specific embodiments of the present invention have been illustrated and described above, variations and modifications to the pallet can be made without departing from the present inventive concept. For example, the bearers of the pallet may be constructed from a drawn rectangular steel tube with the necessary openings 11 formed therein.

I claim:

1. A pallet comprising a pair of elongate bearers separated by an upper array of planks or slats and a lower array of planks or slats, each plank or slat having its longitudinal direction at right angles to the elongate direction of the bearers, characterised in that:

(a) each bearer is a hollow metal member of rectangular cross section, having an upper wall, a lower wall, an inner wall and an outer wall;

(b) each bearer has an upper and a lower linear array of openings formed in the corners of the bearer at (i) the junction of the upper wall and the inner wall and (ii) the junction of the lower wall and the inner wall, each of the openings in the upper array extending into the upper wall and into the adjacent inner wall of the bearer, and each of the openings in the lower array extending into the lower wall and into the adjacent inner wall of the bearer; each of said openings having a width such that it receives one end of one of said slats or planks; and (c) each slat or plank has a pair of slots formed in one face thereof, each slot extending at right angles to the elongate direction of the slat or plank and having a thickness substantially equal to the thickness of the inner wall of a bearer, each slot being a distance from a respective end of its slat or plank which is equal to or less than the distance between the faces within a bearer of its inner and outer walls; the vertical distance between the level of the inside face of the upper wall and the level of the lowermost horizontal edge of an opening in said upper array of openings being equal to the vertical distance between the level of the inside face of the lower wall and level of the uppermost horizontal edge of an opening in said lower array of openings, which is slightly less than the distance between the bottom of a slot in a slat or plank and the face of such slat or plank in which a slot is not formed; each of said upper array of planks or slats being positioned so that each of their slots is engaged by a respective lowermost edge of an opening in said upper array of openings, and each of said lower array of planks or slats being positioned so that each of their slots is engaged by a respective uppermost edge of an opening in said lower array of openings.

2. A pallet as defined in claim 1, in which each bearer is provided with side access for the tynes of a fork-lift, said side access comprising a pair of rectangular apertures formed in the outer wall of the bearer, a corresponding pair of rectangular apertures formed in the inner wall of the bearer, and a pair of hollow metal box sections extending between the inner and outer walls of the bearer and being affixed to the edges of respective corresponding apertures in the inner and outer walls.

3. A pallet as defined in claim 1, including a rectangular metal plate affixed to each end of each bearer, the dimensions of said metal plate being substantially the same as the cross-sectional dimensions of the bearers.

4. A pallet as defined in claim 3, in which each metal plate has a pair of tongues projecting from the upper and lower ends respectively of the side of the plate which is adjacent to the inner wall of a bearer, to provide protection for the end planks or slats of the pallet.

5. A pallet as defined in claim 1, in which each bearer is constructed from a flat sheet of metal having apertures punched therein or cut therefrom, said flat sheet of metal being press-bent to form a bearer in which the side edges of the metal sheet overlap each other, thus defining a region of overlap, the adjacent metal surfaces of at least part of said region of overlap being rigidly connected to each other.

6. A pallet as defined in claim 1, in which the metal is steel.

7. A pallet as defined in claim 1, in which each bearer comprises (a) an elongate channel-shaped member having first and second arms extending from a web, said first and second arms corresponding to the upper and lower walls of the bearer and said web corresponding to the outer wall of the bearer; a plurality of equi-spaced rectangular regions being removed from the ends of the arms which are remote from the web, the vacant rectangular portions thus created corresponding to part of the openings in the bearer; and (b) an elongate rectangular plate having a length equal to the length of said channel-shaped member and a width substantially equal to the separation of the arms of the channel-shaped member, a plurality of equi-spaced rectangular regions being removed from complementary locations in the edge regions of said elongate place, the vacant rectangular portions thus created corresponding to part of the openings in the bearer, said elongate rectangular plate being aligned with and welded to the ends of the arms of said channel-shaped member.

8. A pallet as defined in claim 1, in which each of said slats or planks is made from softwood.

9. A pallet as defined in claim 1, in which the planks or slats are removed from the bearers to thereby form a kit for the pallet.

* * * * *